US009382700B2

(12) United States Patent
Blum

(10) Patent No.: US 9,382,700 B2
(45) Date of Patent: Jul. 5, 2016

(54) JET REGULATOR

(75) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 762 days.

(21) Appl. No.: 13/578,643

(22) PCT Filed: Feb. 8, 2011

(86) PCT No.: PCT/EP2011/000579
§ 371 (c)(1),
(2), (4) Date: Aug. 13, 2012

(87) PCT Pub. No.: WO2011/098253
PCT Pub. Date: Aug. 18, 2011

(65) Prior Publication Data

US 2012/0325933 A1 Dec. 27, 2012

(30) Foreign Application Priority Data

Feb. 13, 2010 (DE) ..... 10 2010 007 871

(51) Int. Cl.
*E03C 1/08* (2006.01)

(52) U.S. Cl.
CPC ..... *E03C 1/08* (2013.01); *E03C 2201/70* (2013.01)

(58) Field of Classification Search
CPC ..... E03C 2201/70; E03C 1/08
USPC ..... 239/428.5, 553.3, 590.3; 137/504
See application file for complete search history.

(56) References Cited

U.S. PATENT DOCUMENTS

| | | | | |
|---|---|---|---|---|
| 4,470,546 | A * | 9/1984 | Wildfang | 239/428.5 |
| 6,892,964 | B2 * | 5/2005 | Grether et al. | 239/428.5 |
| 7,661,608 | B2 * | 2/2010 | Grether | 239/500 |
| 7,731,107 | B2 * | 6/2010 | Grether | 239/500 |
| 7,757,969 | B2 * | 7/2010 | Lacher et al. | 239/428.5 |
| 8,205,810 | B2 * | 6/2012 | Lacher et al. | 239/428.5 |
| 8,348,227 | B2 * | 1/2013 | Zoller | 251/120 |

FOREIGN PATENT DOCUMENTS

| | | |
|---|---|---|
| DE | 4436193 | 4/1996 |
| DE | 10115639 | 10/2002 |
| DE | 10162662 | 5/2006 |
| DE | 202006008624 | 11/2007 |

OTHER PUBLICATIONS

Google translated English equivalent of DE4436193 by Gransow Eckhard.*

* cited by examiner

*Primary Examiner* — Arthur O Hall
*Assistant Examiner* — Chee-Chong Lee
(74) *Attorney, Agent, or Firm* — Volpe and Koenig, P.C.

(57) ABSTRACT

A jet regulator (1) including a two-part jet-regulator housing (2), the outlet end face (3) of which has multiple passages (4), a pot-shaped inlay (6) that is inserted into the housing interior (2) until it reaches the outlet end face (3) and that has multiple tubular spray nozzles (7), each of which penetrates a passage (4) on the outlet end face of the jet regulator housing (2) and the free spray-nozzle region of which protrudes beyond the outlet end face (3) of the jet regulator (1, 5). The jet regulator also includes an insert (8) that is inserted in the housing interior and the position of the inlay part (6) is secured in an axial direction between the insert, the second housing part and the outlet end face (3).

14 Claims, 6 Drawing Sheets

JET REGULATOR

BACKGROUND

The invention relates to a jet regulator having a jet regulator housing which has, on its outlet face side, a plurality of through-holes, having an inlay part which is inserted into the housing interior of the jet regulator housing as far as the outlet face side and which, on a base element, has a plurality of hose-like spray nozzles comprised of soft elastic material, which spray nozzles extend through in each case one outlet-face-side through-hole of the jet regulator housing and project with their free spray nozzle end region beyond the outlet face side of the jet regulator, and having an insert part which is inserted in and/or projects into the housing interior, between which insert part and the outlet face side the inlay part is secured in position in the axial direction.

A jet regulator of the type mentioned in the introduction, having a jet regulator housing which has, on its outlet face side, a plurality of through-holes, is already-known from DE 44 36 193 A1. The already-known jet regulator is assigned an inlay part which is inserted into the housing interior of the jet regulator housing as far as the outlet face side and which has a plurality of hose-like spray nozzles comprised of soft elastic material, which spray nozzles extend through in each case one outlet-face-side through-hole of the jet regulator housing. The spray nozzles which extend through in each case one outlet-face-side through-hole project with their free spray nozzle end region beyond the outlet face side of the jet regulator in such a way that said projecting spray nozzle ends can be deformed by a user running their hand over them, such that any limescale encrustations etc. can be easily removed. To be able to secure the disk-shaped inlay part, which has the spray nozzles, in the jet regulator housing, an inflow-side component which is for example in the form of a perforated plate with integrally formed flow chambers is pressed with its downstream face sides against the inlay part, and sealed off, as an outlet mouthpiece including within it the already-known jet regulator is screwed into the outlet fitting, such that the water can emerge only through the spray nozzles. However, as long as the already-known jet regulator is not situated in the outlet mouthpiece and as long as the outlet mouthpiece is not screwed onto the outlet fitting, the individual constituent parts of the already-known jet regulator are merely placed relatively loosely into one another and can easily become detached from one another during storage, transport or assembly. DE 44 36 193 A1 therefore also proposes that the inlay part which has the spray nozzles not be formed as a separate disk, but that rather the inlay part be molded as a composite material directly onto the jet regulator housing, which however entails significantly increased production outlay.

Already-known from DE 101 15 639 A1 is a jet regulator which has a substantially pot-shaped jet regulator housing, into the housing interior of which can be inserted an insert part which is in the form of a device, comprised of a dimensionally stable thermoplastic, for mixing water with air. The jet regulator housing of the already-known jet regulator has a housing base which is formed integrally on the jet regulator housing. On the housing base there are provided throughflow openings which are bordered and separated from one another by jet delimiting walls arranged parallel to the flow direction. On the water outlet end of said jet delimiting walls there is integrally formed a surface comprised of elastic plastic, which surface can be moved back and forth to such a considerable extent that even limescale deposits which project further inward can be mechanically detached.

The jet regulator housing of the already-known jet regulator is in the form of a multi-component injection molded part in order to be able to integrally form the soft elastic plastic surface on the water outlet end of the jet delimiting walls. However, the production of such a filigree jet regulator housing formed as a multi-component injection molded part requires a complex injection molding die, the construction, manufacture and/or maintenance of which involves considerable outlay.

Already-known from DE 44 36 193 A1 is a jet regulator designed for connecting to a sanitary outlet fitting, which jet regulator has an inflow-side jet splitter device and at least one outflow-side installation part for jet preparation. The already-known jet regulator has an adapter part, which can be connected to the outlet fitting, and an insert part, which can be connected to and separated from the adapter part without tools via a quick-release connection by means of an axial insertion or release movement, in which insert part the at least one installation part is inserted. The at least one installation part is thus accommodated in a secured manner in the housing interior between the inflow-side adapter part and the insert part which is provided at the outflow side and which can be detachably latched to the adapter part.

An inlay part which is inserted into the housing interior of the jet regulator housing as far as the outlet face side and which has a plurality of hose-like spray nozzles comprised of soft elastic material is by contrast not provided in DE 44 36 193 A1. Furthermore, the installation part constitutes an outflow-side component which is held in a detachably latchable manner on the jet regulator housing.

Already-known from DE 101 62 662 A1 is a jet regulator which can be mounted on a sanitary outlet fitting by means of an outlet mouthpiece. The already-known jet regulator has a jet regulator housing which can be inserted into the outlet mouthpiece and whose outlet end side is in the form of a perforated plate. The holes which are provided in the outlet face side which is in the form of a perforated plate, which holes are arranged in a hole ring, are narrowed in terms of their hole outlet cross section on the radially inner or outer hole side in relation to the hole ring by a stepped projection, which extends over a segment of the hole cross section, in such a way that the thereby diverted water jets emerge as a soft, slightly conical overall jet. Further components of the already-known jet regulator are not described in any more detail in DE 101 62 662 A1.

SUMMARY

It is therefore the object to provide a jet regulator of the type mentioned in the introduction, the production of which requires less outlay even in the case of relatively low production quantities, without the risk of leakage flows which influence the jet appearance of the jet regulator.

The object is achieved according to the invention, in the case of the jet regulator of the type mentioned in the introduction, in particular by means of the features of the present invention.

The jet regulator according to the invention has a jet regulator housing which has, on its outlet face side, a plurality of through-holes. The jet regulator according to the invention also has a separate inlay part which is inserted into the housing interior of the jet regulator housing as far as the outlet face side. The inlay part has a base element on which there are provided a plurality of hose-like spray nozzles comprised of soft elastic material, which spray nozzles extend through in each case one outlet-face-side through-hole of the jet regulator housing and project with their free spray nozzle end region beyond the outlet face side of the jet regulator. The inlay part also has a circumferential edge region which projects counter to the inflow direction and which is designed as a sealing edge which bears sealingly against the housing inner circumference. Since the inlay part bears sealingly with its circumferential edge region, which projects counter to the inflow direction, against the housing inner circumference, the water flowing through the jet regulator according to the invention can emerge only through the spray nozzles, and undesired leakage flows between the inner circumference of the jet regulator housing on the one hand and the outer circumference of the inlay part on the other hand are prevented. To secure the separate inlay part, which is inserted into the housing interior, in the axial direction of the jet regulator and hold down said inlay part in the housing interior on the outlet face side, an insert part is provided which is likewise inserted into the housing interior and/or projects into the housing interior, between which insert part and the outlet face side the inlay part is secured in position in the axial direction. In the jet regulator according to the invention, the jet regulator housing on the one hand and the outlet-side spray nozzles on the other hand need not be produced as multi-component injection-molded parts in a complex injection molding die, it rather also being possible for the components of the jet regulator according to the invention to be produced separately from one another in separate and relatively simple injection molding dies. Even though the separately produced components of the jet regulator according to the invention are inserted into one another merely in an easily detachable manner, the inlay part with its soft elastic spray nozzles, which are also subjected to not possibly inconsiderable manual exertion of force for the detachment of limescale deposits, is arranged secured in position in the housing interior in such a way that there is no risk of functionally detrimental relative displacements of the components assembled to form the jet regulator according to the invention.

Since the jet regulator according to the invention has an inflow-side component which is held in a releasably latchable manner on the jet regulator housing or on a housing part of the jet regulator housing, and since the insert part is itself secured in the housing interior of the jet regulator housing by the inflow-side component, the inlay insert parts situated in the housing interior of the jet regulator housing are securely and captively accommodated therein at all times. It is thus necessary for the latching connection between the inflow-side component and the jet regulator housing, or the housing part of the jet regulator housing, to be released before the insert part and the inlay part, which is secured in the housing interior in the axial direction by the insert part, can be removed.

It is advantageous for the base element of the inlay part to be of plate-shaped or disk-shaped form.

A preferred embodiment of the invention provides that the inlay part has a pot-shaped sub-region, and that the base element of the inlay part forms the pot base. In this embodiment, the inlay part has a pot-shaped sub-region which can also be inserted, positioned correctly in the radial direction, into the jet regulator housing. Here, the pot base of the pot-shaped sub-region forms the base element which, in the housing interior, bears against the outlet face side and on which the hose-like spray nozzles are provided.

In order that the individual jets emerge visibly separated from one another from the spray nozzles of the jet regulator according to the invention, it is advantageous for the spray nozzles to be provided on at least one circular path arranged preferably concentrically around the jet regulator longitudinal axis.

Here, it is provided in one preferred embodiment of the invention that the outlet face side of the jet regulator housing has a hole-free or non-perforated central region and that in particular no spray nozzles are provided in said central region.

In order that the water flowing into the jet regulator according to the invention can be substantially uniformly split up and distributed to the individual spray nozzles, it is expedient if there is inserted into the jet regulator housing a diffuser or a distributor which breaks down the inflowing water flow into a multiplicity of partial flows distributed over the circumference of the diffuser or of the distributor.

Here, it is provided in one preferred embodiment of the invention that the diffuser or the distributor has an annular wall, in which annular wall there are provided a plurality of throughflow openings which are distributed over the circumference of the annular wall and from which at least one duct and preferably one annular duct leads to the spray nozzles.

In order that the individual jets emerging from the spray nozzles of the jet regulator according to the invention can flow out as soft individual jets, and in order that the individual jets are for this purpose slowed to an adequate extent, it is expedient for the distributor to have a preferably central and in particular pot-shaped overflow, the overflow openings of which form the throughflow openings.

It is provided in one preferred embodiment of the invention that the distributor forms the insert part which secures the inlay part in the axial direction.

It is provided in a further embodiment of the invention that the jet regulator housing has at least two housing parts which can be releasably latched to one another and of which the inflow-side housing part forms a component, which secures the insert part in the housing interior, of the jet regulator. Here, it is particularly advantageous for the insert part to be in the form of a hold-down sleeve which is provided between the inflow-side housing part and the inlay part.

To be able to fasten the jet regulator according to the invention to the water outlet of a sanitary outlet fitting, it is provided in one embodiment of the invention that the jet regulator has, on its jet regulator housing, an annular flange by means of which the jet regulator rests on an annular shoulder provided at the inside in an outlet mouthpiece or an intermediate bracket. By means of said outlet mouthpiece, the jet regulator inserted into the mouthpiece can be held on the water outlet of a sanitary outlet fitting.

By contrast, it is provided in another embodiment of the invention that the jet regulator bears, on its jet regulator housing, an external thread by means of which the jet regulator can be screwed into an internal thread provided at the inside on the water outlet of a sanitary outlet fitting. In this embodiment, the jet regulator has, on its jet regulator housing, an external thread by means of which the jet regulator of the jet regulator according to the invention can be screwed into an internal thread provided at the inside on the water outlet of the sanitary outlet fitting, in such a way that the jet regulator is accommodated, over a significant part of its longitudinal extent, in a protected manner in the water outlet of the outlet fitting, without the need for an additional outlet mouthpiece.

It is provided in one preferred refinement of the invention that the jet regulator is assigned a plurality of insert parts which can be selectively inserted into the jet regulator housing, and that one of said inlay parts closes off individual through-holes of the jet regulator housing in order to reduce the throughflow capacity. It is thus possible for one jet regulator to be assigned multiple inlay parts, of which one inlay part extends with its integrally formed hose-like spray nozzles for example through all of the outlet-face-side through-holes of the jet regulator housing in order to attain as high a throughflow capacity as possible, and of which another inlay part has, in relation thereto, a reduced number of spray nozzles which extend through only a correspondingly reduced number of through-holes in the jet regulator housing, while said inlay part sealingly closes off the other through-holes in the jet regulator housing.

BRIEF DESCRIPTION OF THE DRAWINGS

Further features of the invention will emerge from the following description of preferred exemplary embodiments in conjunction with the drawings and the subclaims. Here, the individual features may be realized, and essential to the invention, in each case individually or in combination with one another.

In the drawings.

DETAILED DESCRIPTION OF THE PREFERRED EMBODIMENTS

Figure 1:
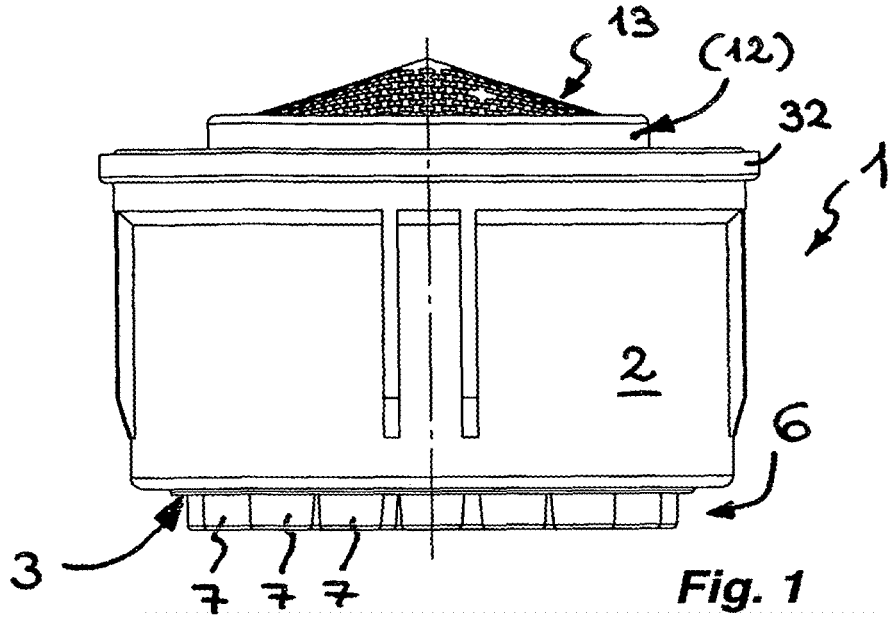
FIG. 1 shows, in one view, a jet regulator which has a plurality of projecting spray nozzles on the outlet face side of its jet regulator housing, wherein in the housing interior of the jet regulator housing there is provided a distributor (not illustrated in any more detail in FIG. 1) which divides the inflowing water into a multiplicity of partial flows flowing to the spray nozzles.
Figure 2:
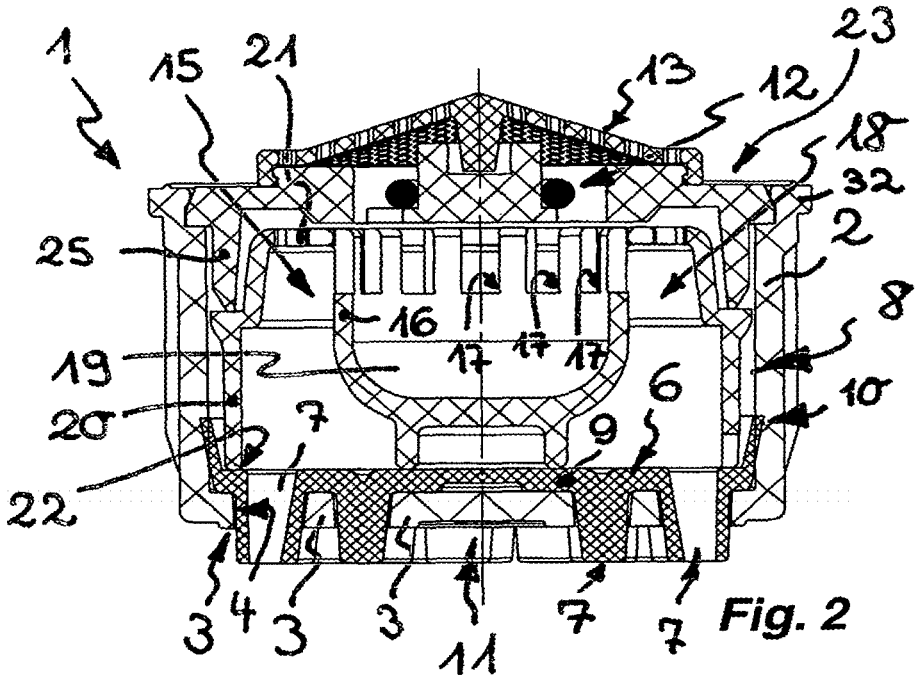
FIG. 2 shows the jet regulator from FIG. 1 in a longitudinal section.
Figure 3:
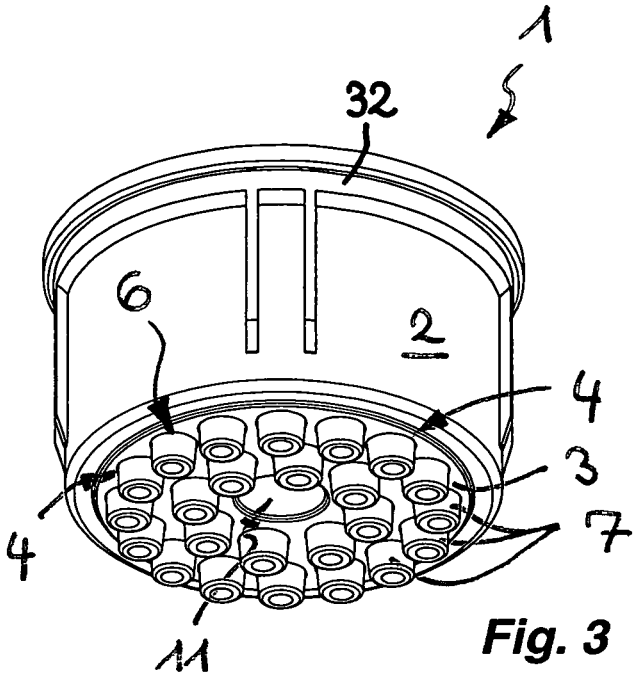
FIG. 3 shows the jet regulator from FIGS. 1 and 2 in a perspective view from below.
Figure 4:
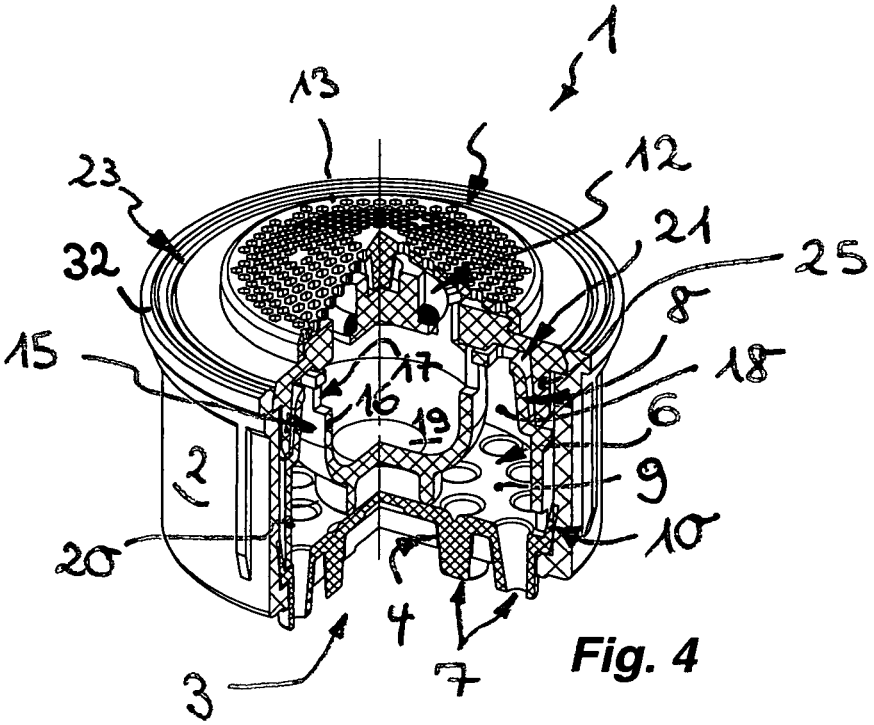
FIG. 4 shows the jet regulator from FIGS. 1 to 3 in a perspective partial longitudinal section.
Figure 5:
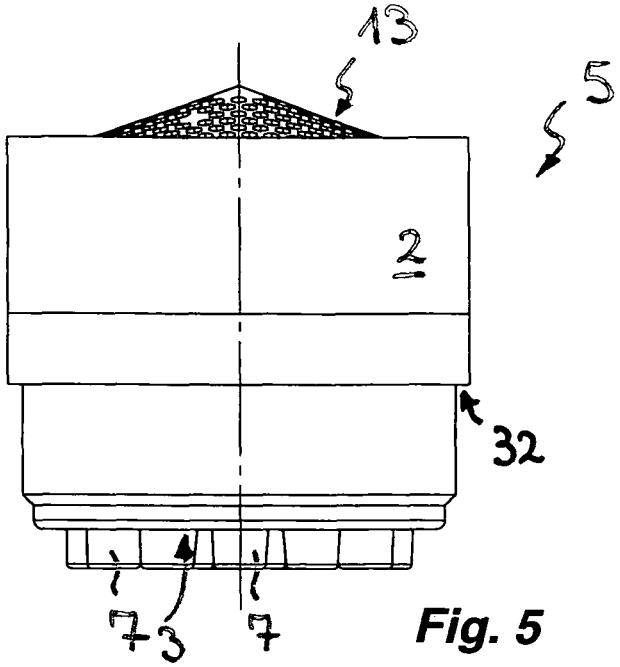
FIG. 5 shows a jet regulator of similar design to that in FIGS. 1 to 4, which jet regulator however has a diffuser (not shown in any more detail here) instead of a distributor in the housing interior of a jet regulator housing.
Figure 6:
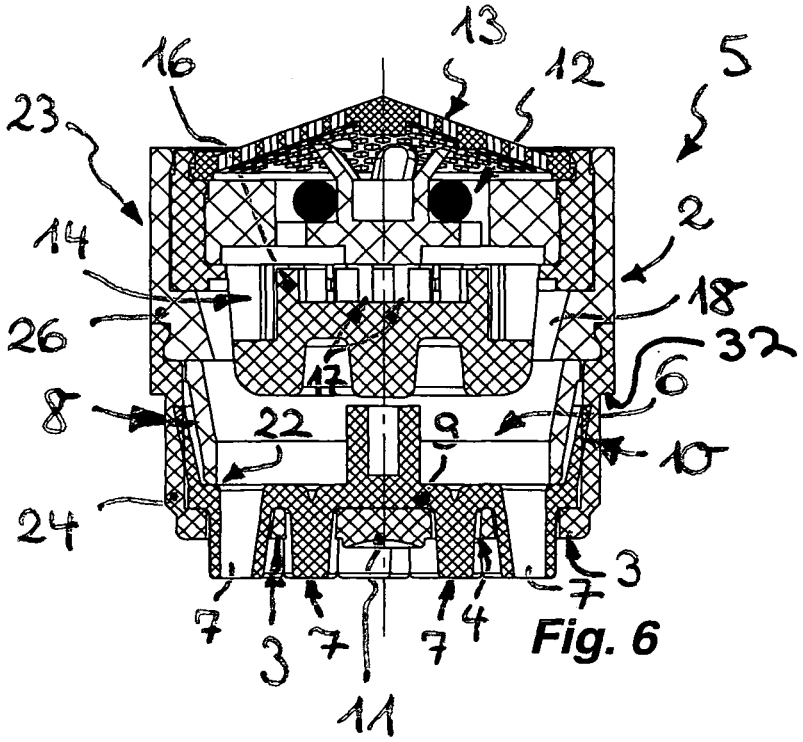
FIG. 6 shows the jet regulator from FIG. 5 in a longitudinal section.
Figure 7:
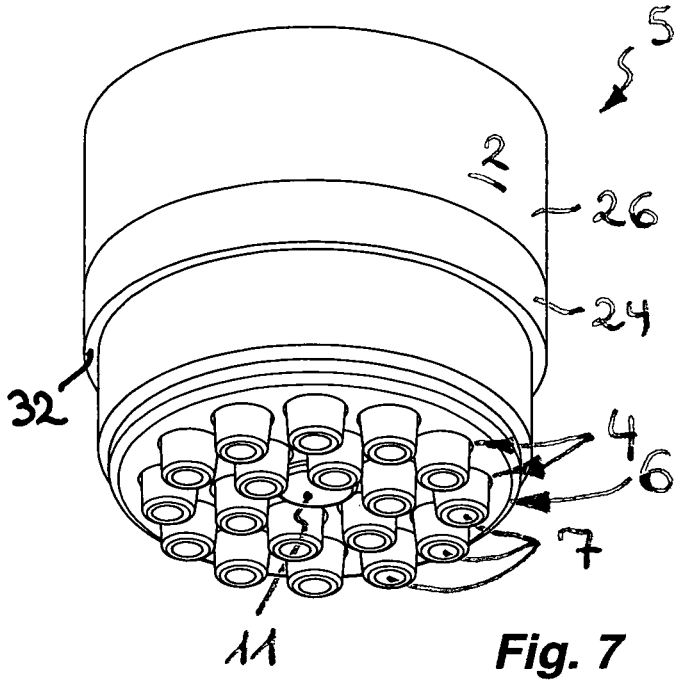
FIG. 7 shows the jet regulator from FIGS. 5 and 6 in a perspective view from below.
Figure 8:
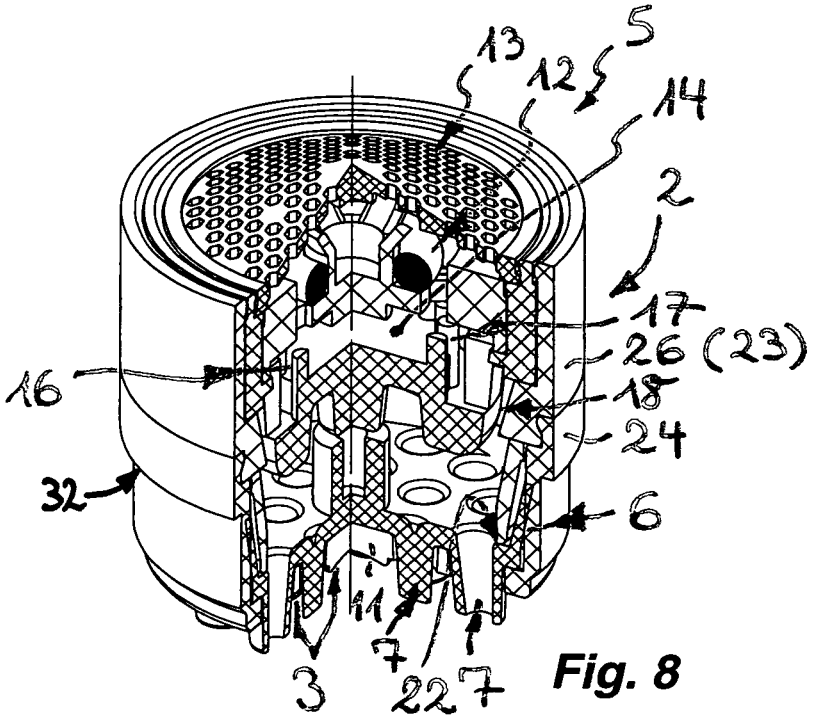
FIG. 8 shows the jet regulator from FIGS. 5 to 7 in a perspective partial longitudinal section.
Figures 9, 10, 11, 12, 13, 14:
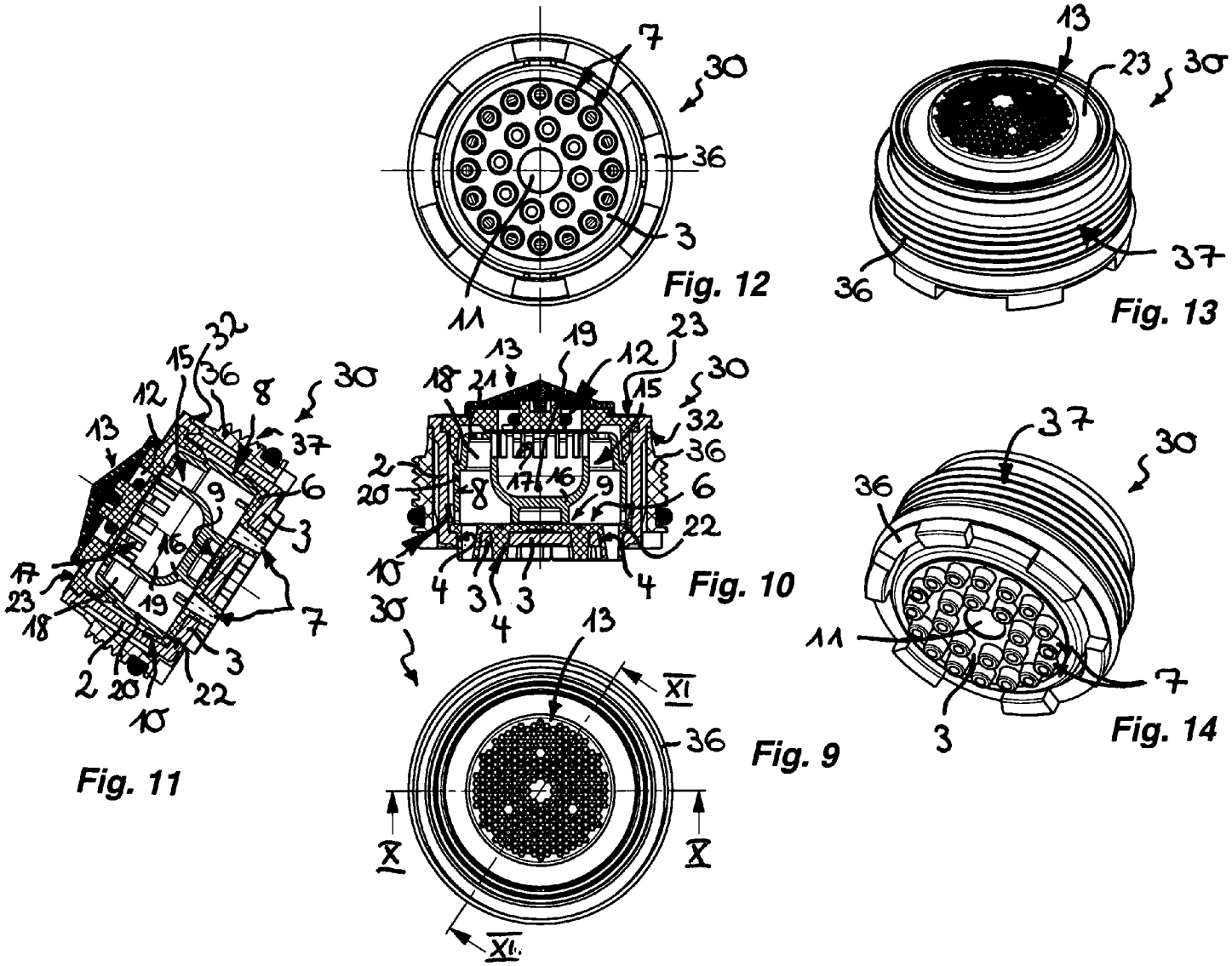
FIG. 9 shows a jet regulator in a plan view directed toward its inflow-side housing face side, which jet regulator bears on its jet regulator housing an external thread by means of which the jet regulator can be detachably screwed into an internal thread provided on the water outlet of a sanitary outlet fitting.
FIG. 10 shows the jet regulator from FIG. 9 in a longitudinal section through the section plane X-X from FIG. 9.
FIG. 11 shows the jet regulator from FIGS. 9 and 10 in a longitudinal section through section plane XI-XI from FIG. 9.
FIG. 12 shows the jet regulator from FIGS. 9 to 11 in a plan view of its outlet face side.
FIG. 13 shows the jet regulator from FIGS. 9 to 12 in a perspective plan view of its inflow-side end face.
FIG. 14 shows the jet regulator from FIGS. 9 and 13 in a perspective plan view of its outflow side.

FIGS. 1 to 17 illustrate different embodiments 1, 5, 30, 31 of a jet regulator from which the water should emerge as a shower-like water jet formed from a multiplicity of individual jets. The substantially pot-shaped jet regulator housing 2 has, on its outlet face side 3 which forms the pot base of the pot-shaped jet regulator housing 2, a plurality of through-holes 4.

The jet regulators 1, 5, 30 and 31 are assigned a separate inlay part 6 which is inserted into the housing interior as far as the outlet face side 3. The inlay part 6 has a plurality of hose-like spray nozzles 7 which are designed to generate a multiplicity of preferably visibly separately emerging individual jets. The spray nozzles 7 extend through in each case one outlet-face-side through-hole 4 of the jet regulator housing 2 and project with their free spray nozzle end region beyond the outlet face side 3 of the jet regulator 1, 5, 30, 31.

The already-known jet regulators 1, 5, 30, 31 also have an insert part 8 which is inserted into the housing interior, between which insert part and the outlet face side 3 the inlay part 6 is secured in position in the axial direction.

In the jet regulators 1, 5, 30, 31 illustrated here, the jet regulator housing 2 on the one hand and the outlet-side spray nozzles 7 on the other hand need not be produced as a multi-component injection-molded part in a complex injection molding die; it is rather also possible for said components to be produced separately from one another in separate and relatively simple injection molding dies. Even though the separately produced components 2, 7 of the jet regulators 1, 5, 30, 31 are inserted into one another merely in an easily detachable manner, the inlay part 6 with its soft elastic spray nozzles 7, which are also subjected to not possibly inconsiderable manual exertion of force for the detachment of limescale deposits, is arranged secured in position in the housing interior in such a way that there is no risk of functionally detrimental relative displacements of the components assembled to form the jet regulators 1, 5, 30, 31.

From the longitudinal sections in FIGS. 2, 4, 6, 8, 10, 11 and 16, it is clear that the inlay part 6 of the jet regulators 1, 5, 30, 31 has a disk-shaped base element 9 on which the hose-like spray nozzles 7 are held. Here, the inlay part 6 has in this case a pot-shaped sub-region whose pot base forms the base element 9 with the spray nozzles 7.

The in this case pot-shaped inlay part 6 of the jet regulators 1, 5, 30, 31 has a circumferential edge region 10 which projects counter to the inflow direction and which is designed as a sealing edge which bears sealingly against the housing inner circumference. For this purpose, the circumferential edge region 10 which projects counter to the inflow direction is oriented obliquely outward such that said circumferential edge region practically forms a lip seal which bears sealingly against the housing inner circumference of the jet regulator housing 2. Since the circumferential edge region 10 of the inlay part 6 bears sealingly against the inner circumference of the jet regulator housing 2, undesired leakage flows between the inlay part 6 and the inner circumference of the jet regulator housing 2 are prevented.

It can be seen from the perspective views from below in FIGS. 3, 7, 14 and 17 that the spray nozzles 7 provided on the jet regulators 1, 5, 30, 31 are provided on circular paths arranged concentrically around the jet regulator longitudinal axis. Here, a non-perforated central region 11 which is not equipped with spray nozzles 7 is provided on the outlet face side of the jet regulator housing 2.

Positioned upstream of the jet regulators 1, 5, 30, 31 is in each case one flow rate regulator 12 which limits the maximum throughflow capacity per unit of time to a pressure-independent maximum value. The flow rate regulator 12 is connected in a latchable or similarly detachable manner to the jet regulators 1, 5, 30, 31 on the inflow side of the latter. In order that the function of the flow rate regulators 12 and of the jet regulators 1, 5, 30, 31 positioned downstream thereof at the outflow side cannot be impaired by dirt particles possibly entrained in the water, in each case one upstream screen 13 is positioned upstream of the flow rate regulators 12 and of the jet regulators 1, 5, 30, 31, which upstream screen is connected likewise in a detachable manner to the flow rate regulator 12 and to the respective jet regulator 1, 5, 30, 31.

Into the jet regulator housing 2 of the jet regulators 1, 5, 30, 31 there is provided a diffuser 14 (cf. FIGS. 5 to 8, 15 to 17) or a distributor 15 (cf. FIGS. 1 to 4, 9 to 14) which breaks the inflowing water flow into a multiplicity of partial flows distributed over the circumference of the diffuser 14 or distributor 15. For this purpose, the components 14, 15 have an annular wall 16 in which are provided a plurality of throughflow openings 17 distributed preferably uniformly over the circumference of the annular wall 16. An annular duct 18 leads from the throughflow openings 17 to the spray nozzles 7 of the inlay part 6.

The distributor 15 of the jet regulator 1, 30 shown in FIGS. 1 to 4 and 9 to 14 has a central overflow 19 which is of substantially pot-shaped form and whose overflow openings form the throughflow openings 17. Here, the distributor 15 forms the insert part 8 which secures the inlay part 6 in the axial direction. The distributor 15 has for this purpose an outer annular wall 20 which surrounds the pot-shaped overflow 19 with a spacing and which is connected to said overflow via an inflow-side, annularly encircling perforated or connecting plate 21 which is arranged approximately in a radial plane. The outer annular wall 20 of the distributor 15 rests with its outflow-side face end region on an annular shoulder 22 of the inlay part 6 in such a way that the inlay part 6 is secured in position in the jet regulator 1, 30 so as to be immovable in the axial direction.

It is clear from a comparison of FIGS. 1 to 4, 5 to 8, 9 to 14 and 15 to 17 that each jet regulator 1, 5, 30, 31 has an inflow-side component 23 which is held in a detachably latchable manner on the jet regulator housing 2 or on a housing part 24 of the jet regulator 1, 5, 30, 31. Here, the insert part 8 which secures the inlay part 6 in the axial direction is itself secured in the housing interior of the jet regulator housing 2 by the inflow-side component 23.

While it is the case in the jet regulators 1, 30, 31 illustrated in FIGS. 1 to 4 and 9 to 17 that the flow rate regulator 12 forms the component 23 that can be detachably latched in the inflow-side region of the jet regulator 1 and which bears with an annular wall 25 against the distributor 15 or the diffuser 14, the jet regulator housing 2 of the jet regulator 5 shown in FIGS. 5 to 8 has two housing parts 24, 26, the inflow-side housing part 24 of which forms a component 23, which secures the insert part 8 in the housing interior, of the jet regulator 5. The insert part 8 of the jet regulator 5 is in this case formed as a hold-down sleeve which tapers in the inflow direction and which bears at the inflow side against the adjacent face end region of the housing part 24 and at the outflow side against an annular shoulder 22 of the inlay part 6. It can be seen from the longitudinal section in FIG. 6 that that duct portion of the annular duct 18 which is formed between the diffuser 14 and the adjacent inner circumference of the housing part 24 tapers such that, in said region, a vacuum is generated which can be used for sucking air into the housing interior of the jet regulator housing 2, wherein it is intended for the air to be mixed with the water flowing through.

The jet regulators 1, 5 have a jet regulator housing 2 which can be inserted into an outlet mouthpiece (not illustrated in any more detail here) which can be mounted on the outlet end of a sanitary outlet fitting. For this purpose, the jet regulators 1, 5 have, on their jet regulator housing 2, an annular flange or annular shoulder 32 by means of which the jet regulator 1, 5 rests on an annular shoulder provided at the inside in the outlet mouthpiece.

The jet regulator 30 also has an annular flange or annular shoulder 32 on the housing outer circumference of its jet regulator housing 2. The jet regulator 30 can be inserted into an intermediate bracket 36 from the inflow side of the latter until the annular flange or annular shoulder 32 of the jet regulator comes to rest on an annular shoulder provided on the inner circumference of the sleeve-shaped intermediate bracket or on the inflow-side face edge of the intermediate bracket 36. The jet regulator 30 can be fastened in the water outlet of a sanitary outlet fitting by means of the intermediate bracket 36. For this purpose, the sleeve-shaped intermediate bracket 36 has, on its outer circumference, an external thread 37 by means of which the intermediate bracket 36 can be detachably screwed into an internal thread on the water outlet of a sanitary outlet fitting.

By contrast, the jet regulator 31 bears on its jet regulator housing 2 an external thread 33 by means of which the jet regulator 31 can be screwed into an internal thread provided at the inside on the water outlet of an outlet fitting (likewise not illustrated here).

Figure 15:
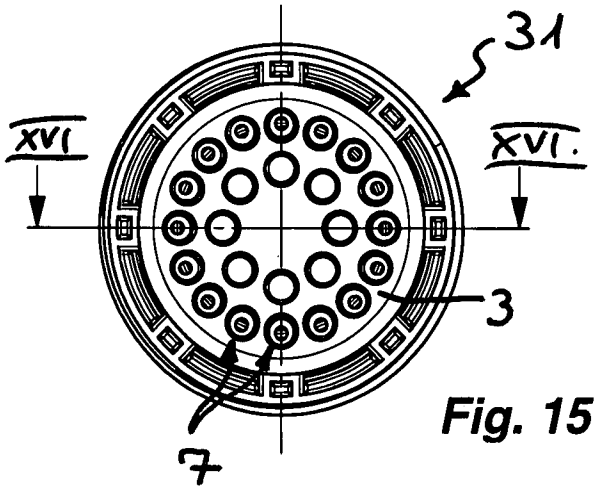
FIG. 15 shows a significantly more compact jet regulator which is characterized by a comparatively short structural height and which likewise bears on its jet regulator housing an external thread by means of which the jet regulator can be detachably screwed into an internal thread provided on the water outlet of a sanitary outlet fitting, wherein on an elastic inlay part of the jet regulator there are integrally formed only a reduced number of spray nozzles which extend through a corresponding number of through-holes on the outlet face side of the jet regulator housing, while the inlay part sealingly closes off those through-holes of the jet regulator housing which are arranged on an inner circular path.
Figure 16:
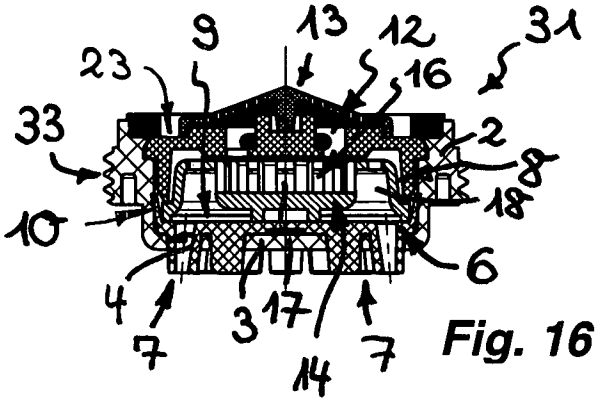
FIG. 16 shows the jet regulator from FIG. 15 in a longitudinal section through section plane XVI-XVI in FIG. 15.
Figure 17:
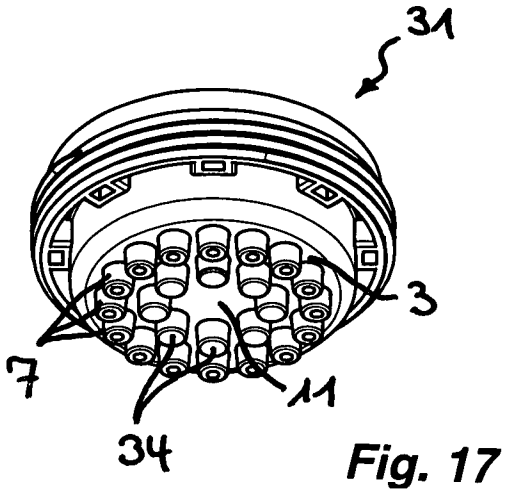
FIG. 17 shows the jet regulator from FIGS. 15 and 16 in a perspective view of its outlet face side.

While the inlay parts 6 of the jet regulators 1, 5, 30 have provided therein a corresponding number of spray nozzles 7 such that said spray nozzles 7 can all extend through through-holes 4 provided in the jet regulator housing 2, the jet regulator 31 in FIGS. 15 to 17 has in relation thereto a reduced number of spray nozzles 7 on its inlay part 6, wherein the inlay part 6 of the jet regulator 31 sealingly closes off those through-holes 4 of the jet regulator housing 2 which are arranged on the inner circular path in order to reduce the throughflow capacity. To be able to sealingly close off those through-holes 4 of the jet regulator housing 2 which are arranged on the inner circular path, spray-nozzle-shaped studs 34 are in this case provided on the inlay part 17, which studs extend through and sealingly close off the through-holes 4 provided on the inner circular path.

It is clear from FIGS. 15 to 17 that the jet regulators illustrated here may also be part of a modular jet regulator construction kit or system. Here, the jet regulator 31 may also be assigned a plurality of inlay parts 6 which can be selectively inserted into the jet regulator housing 2 and of which the inlay part 6 illustrated merely by way of an example in FIGS. 15 to 17 closes off individual through-holes 4 of the jet regulator housing 2 in order to reduce the throughflow capacity. The jet regulator 31 shown in FIGS. 15 to 17 is designed for a low throughflow capacity. Since the through-holes 4 arranged on the inner circular path are closed off by the studs 34 which project from the inlay part 6, the water can emerge only through the spray nozzles 7 arranged on the outer circular path. The advantage of the jet regulator design shown in FIGS. 15 to 17 is that only the inlay part 6 and therefore only a single component must be changed in order to adapt the jet regulator 31 to a different throughflow capacity. It is selfevident that the inlay part 6 shown in FIGS. 15 to 17 may also be used in jet regulator designs such as are shown in FIGS. 1 to 14.

The invention claimed is:

1. A jet regulator (1, 5) comprising a jet regulator housing (2) which has, on an outlet face side (3), a plurality of through-holes (4), having an inlay part (6) inserted into a housing interior of the jet regulator housing (2) as far as the outlet face side (3) and which, on a base element (9), has a plurality of hose-like spray nozzles (7) comprised of an elastic material, said spray nozzles respectively extend through one of the through-holes (4) on the outlet face side of the jet regulator housing (2) and project at a free spray nozzle end region beyond the outlet face side (3) of the jet regulator (1, 5), and having an insert part (8) which is at least one of inserted in or projects into the housing interior, the inlay part (6) is secured in position in an axial direction between said insert part and the outlet face side (3), the jet regulator (1, 5) has an inflow-side component (23) which is held in a releasably latchable manner on the jet regulator housing (2) or on a portion thereof, the insert part (8) is itself secured in the housing interior of the jet regulator housing (2) by the inflow-side component (23), and the inlay part (6) has a frustoconical circumferential edge region (10) which fans out and projects counter to an inflow direction and which is designed as a sealing edge which bears sealingly against a housing inner circumference as fluids are flowing into an inner circumference surface of the frustoconical circumferential edge region of the inlay part.

2. The jet regulator as claimed in claim 1, wherein the inlay part (6) has a pot-shaped portion and the base element (9) of the inlay part (6) forms a base of the pot-shaped portion.

3. The jet regulator as claimed in claim 1, wherein the spray nozzles (7) are provided on at least one circular path.

4. The jet regulator as claimed in claim 1, wherein the outlet face side (3) of the jet regulator housing (2) has a hole-free or non-perforated central region (11).

5. The jet regulator as claimed in claim 1, wherein there is inserted into the jet regulator housing (2) a diffuser (14) or a distributor (15) which breaks down an inflowing water flow into a multiplicity of partial flows distributed over a circumference of the diffuser (14) or of the distributor (15).

6. The jet regulator as claimed in claim 5, wherein the diffuser (14) or the distributor (15) has an annular wall (16), in said annular wall there are provided a plurality of through-flow openings (17) which are distributed over a circumference of the annular wall (16) and from which at least one duct leads to the spray nozzles (7).

7. The jet regulator as claimed in claim 6, the distributor (15) has an overflow (19), overflow openings of which form the throughflow openings (17).

8. The jet regulator as claimed in claim 5, wherein the distributor (15) forms the insert part (8) which secures the inlay part (6) in the axial direction.

9. The jet regulator as claimed in claim 1, wherein the jet regulator housing (2) has at least two housing parts (24, 26) which can be releasably latched to one another and of which an inflow-side housing part (24) forms a component (23), which secures the insert part (8) in the housing interior, of the jet regulator (5).

10. The jet regulator as claimed in claim 9, wherein the insert part (8) is in the form of a hold-down sleeve which is provided between the inflow-side housing part (24) and the inlay part (6).

11. The jet regulator as claimed in claim 1, wherein the jet regulator (1, 5, 30) has, on the jet regulator housing (2), an annular flange (32) by which the jet regulator (1, 5, 30) rests on when installed in an outlet mouthpiece or an intermediate bracket.

12. The jet regulator as claimed in claim 11, wherein the jet regulator is releasably held in the water outlet of a sanitary outlet fitting by the intermediate bracket (36), and for this purpose, the intermediate bracket (36) bears on an outer circumference an external thread (37) by which the intermediate bracket (36) can be screwed into an internal thread provided on the inside of the water outlet of a sanitary outlet fitting.

13. The jet regulator as claimed in claim 1, wherein the jet regulator (30, 31) bears, on the jet regulator housing (2), an external thread (33) by which the jet regulator (30, 31) can be screwed into an internal thread provided at an inside on the water outlet of a sanitary outlet fitting.

14. The jet regulator as claimed in claim 1, wherein the jet regulator (31) is assigned a plurality of the inlay parts (6) which can be selectively inserted into the jet regulator housing (2), and one of the inlay parts (6) is provided which closes off individual through-holes (4) of the jet regulator housing (2) in order to reduce a throughflow capacity of the jet regulator (31).

* * * * *